US005439232A

United States Patent [19]

Pollock

[11] Patent Number: 5,439,232

[45] Date of Patent: Aug. 8, 1995

[54] EDUCATIONAL CARD GAME

[76] Inventor: John S. Pollock, 1018 High Vista Trail, Webster, N.Y. 14580

[21] Appl. No.: 5,074

[22] Filed: Jan. 15, 1993

[51] Int. Cl.[6] ..... A63F 9/18; A63F 1/02

[52] U.S. Cl. ..... 273/431; 273/294; 273/302; 434/347

[58] Field of Search ..... 273/429–432, 273/301, 302, 308, 296, 309, 148 A; 434/324, 331, 405, 348, 347

[56] References Cited

U.S. PATENT DOCUMENTS

| | | | |
|---|---|---|---|
| 1,292,184 | 1/1919 | Wells . | |
| 1,385,623 | 7/1921 | Kellogg | 434/327 |
| 1,635,734 | 7/1927 | Ziegler | 434/327 X |
| 1,745,946 | 2/1930 | Murray | 273/308 X |
| 2,717,156 | 9/1955 | Nelson | 273/248 |
| 3,068,010 | 12/1962 | Hagopian | 273/302 X |
| 3,143,348 | 8/1964 | Carsen et al. | 273/152.1 |
| 3,473,809 | 10/1969 | Day | 273/148 A |
| 3,678,602 | 7/1972 | Alam | 273/148 A |
| 4,105,202 | 8/1978 | McLaren et al. | 273/309 |
| 4,273,337 | 6/1981 | Carrera et al. | 273/243 |
| 4,326,711 | 4/1982 | Giallombardo | 434/327 X |
| 4,679,796 | 7/1987 | Rein | 273/236 |
| 4,801,149 | 1/1989 | Alnafissa | 273/302 |
| 4,890,844 | 1/1990 | Weiss | 273/308 X |
| 5,054,775 | 10/1991 | Banks et al. | 273/431 |

FOREIGN PATENT DOCUMENTS

| | | | |
|---|---|---|---|
| 254597 | 2/1963 | Australia | 434/347 |

*Primary Examiner*—Paul E. Shapiro
*Attorney, Agent, or Firm*—Fred L. Denson

[57] ABSTRACT

An educational card game is described which requires a player to identify an object shown in a dictionary-like illustration on the front side of a card. The spelling of the object is alphabetically sequenced between two other words that also appear on the front side. An answer word which identifies the object, together with its pronunciation and definition, are on the back side of the card. The game is played with a large but indefinite number of special cards which are included in a deck. A method for playing the game is also described.

5 Claims, 2 Drawing Sheets

EDUCATIONAL CARD GAME

BACKGROUND OF THE INVENTION

1. Field of the Invention

The present invention relates to an educational card game which requires a player to identify an object shown in a dictionary-like illustration on the front side of a card. The spelling of the object is alphabetically sequenced between two other words that also appear on the front side. An answer word which identifies the object, together with its pronunciation and definition, are on the back side of the card. The invention also includes a method for playing the educational card game.

2. Description of the Prior Art

It has long been known in the art to play educational card games using cards with pictures on one side and information on the other side. U.S. Pat. No. 1,292,184 describes a deck of playing cards which are designed to educate players about the various states of the United States. U.S. Pat. No. 3,143,348 describes a card game which helps to build vocabulary skills. These cards have information on both sides and also include means for classifying the cards into categories based on certain identifying indicia. U.S. Pat. No. 4,801,149 describes an educational card game wherein each card has a set of questions on one side.

While several educational games are known for increasing a person's vocabulary, the prior art does not suggest an educational card game that uses replicas of actual dictionary illustrations as a means for vocabulary building.

It is therefore an object of this invention to provide an educational card game that is designed to enhance an individual's knowledge of words that identify or describe pictures such as they actually appear in a published dictionary.

It is a further object of this invention to provide a challenging and competitive method for playing the educational card game of this invention using a deck of specially designed cards.

SUMMARY OF THE INVENTION

In accordance with the present invention, an educational card game is provided which is played with a large but indefinite number of special cards which are included in a deck. The front side of each card bears a picture such as appears on a page in the main body of a dictionary. Also appearing on the front side of the card are two words or phrases which alphabetically bracket the word or phrases represented by the picture. The bracketing words or phrases typically are words which appear first and last on the same page of the dictionary on which the picture appears. The back side of the card includes an answer word or phrase which identifies the object illustrated in the picture on the front side. The answer word or phrase may optionally be accompanied by the text which follows it in the dictionary (e.g. pronunciation, part of speech and definition or definitions).

The game is played by any number of persons, from 1 to 8 or more. A contestant, upon viewing only the front side of the card, attempts to identify the illustrated object by stating the answer word on the back side of the card. A score is awarded for a correct identification and is reflected either numerically on a score sheet or by advancement of a piece on a game board.

While the game of this invention is educational in that it is designed to increase an individual's knowledge and awareness of dictionary words, it is also entertaining and competitive. The invention and its objects and advantages will become more apparent by referring to the accompanying drawings and to the ensuing detailed description of the preferred embodiment.

DETAILED DESCRIPTION OF PREFERRED EMBODIMENTS

Figure 1A:
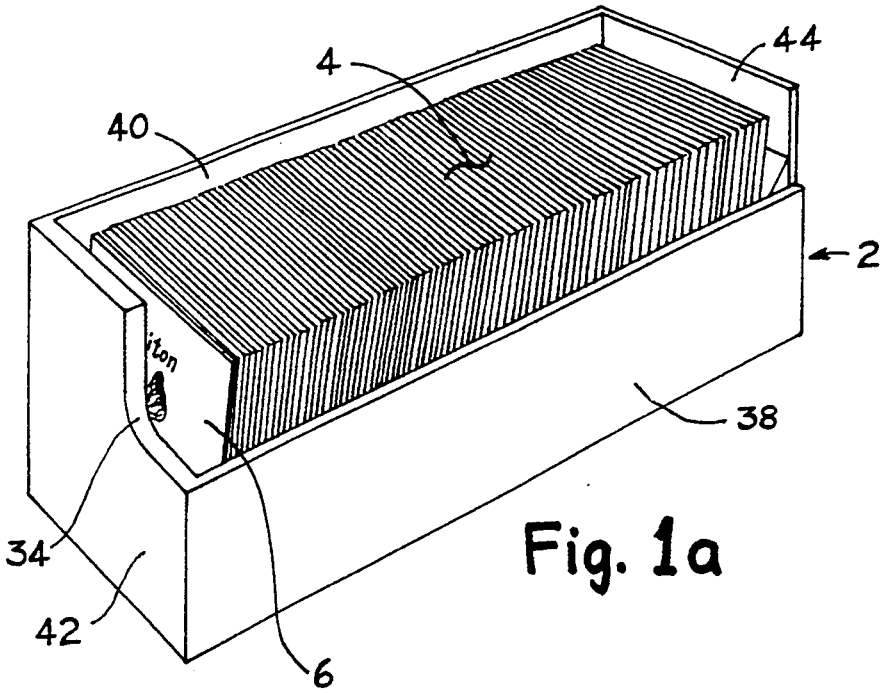
FIGS. 1*a*, 1*b* and 1*c* are perspective views of a container having a deck of cards positioned therein for the game of this invention.
Figure 1B:
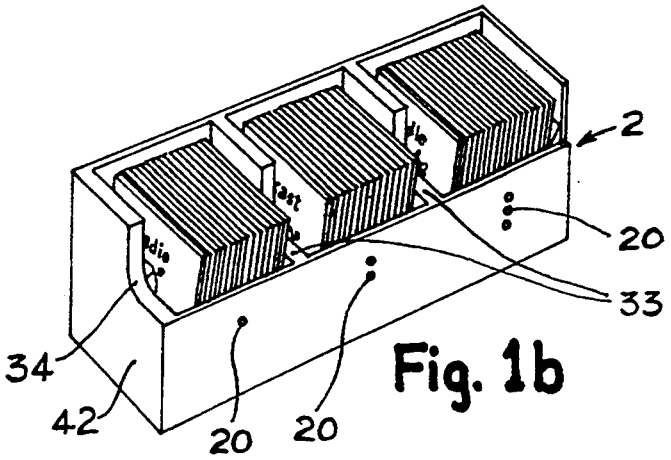
Figure 1C:
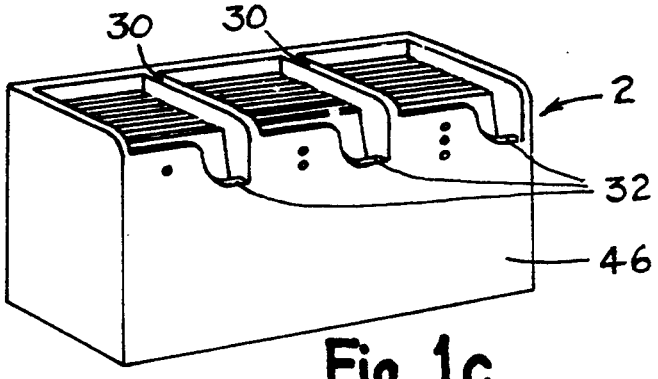

As shown in FIG. 1*a*, a deck of cards 4 is stored in a container 2 having front 38, back 40, a bottom (not shown) side 42 with a cutaway portion 34 and side 44 without a cutaway portion. Deck 4 is comprised of a number of cards 6 which are stored in container 2 in a manner such that the face of the first card in the deck is positioned adjacent to side 42 with cutaway portion 34. Such placement facilitates the card's retrieval from the container. At times, for reasons described later, it is advantageous to divide deck 4 into separate portions and to store each portion separately in container 2. This is accomplished by dividing container 2 into compartments by partitions 30 as shown in FIGS. 1*b* and 1*c*. In FIG. 1*b*, a portion of deck 4 is stored in each compartment and the deck is oriented in a manner such that the face of the first card in each portion is adjacent to side 42 and cutaway 34 or partition 30 and cutaway 33 of container 2. In FIG. 1*c*, a portion of deck 4 is also stored in each compartment but the deck is oriented in a manner such that the face of the first card in each portion is adjacent to front 46 at a cutaway portion 32.

Figure 2A:
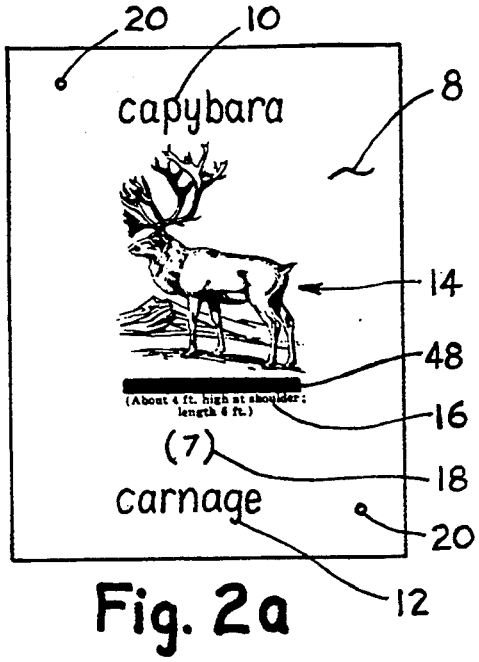
FIG. 2*a* is a planar front view of a card used in the game of this invention.
Figure 2B:
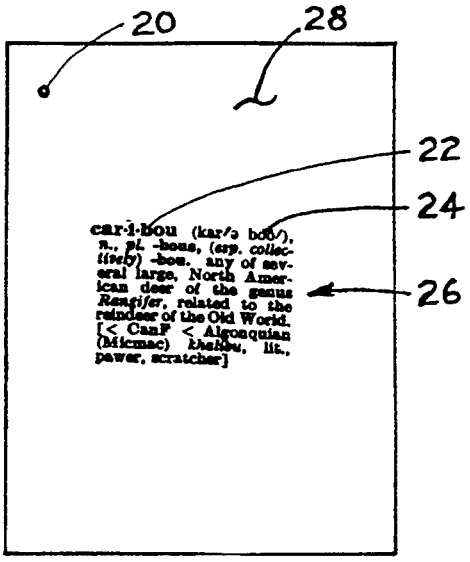
FIG. 2*b* is a planar rear view of the card shown in FIG. 2*a*.

Each card 6 in deck 4 has a front side 8 and a back side 28 as shown in FIGS. 2*a* and 2*b*. Front side 8 includes a first word, "capybara" 10, positioned on the upper section of the card and a second word, "carnage" 12, positioned on the lower section of the card. An illustration 14 is positioned in the middle section of the card between the first word 10 and the second word 12. Illustration 14 depicts an object identifiable by a word or words the spelling of which is alphabetically sequenced between the spelling of the first word 10 and the spelling of the second word 12. A first set of indicia comprising one, two or three circles is positioned in the upper section of the card. The indicia is reflective of the level of difficulty of identifying the illustrated object. A set of indicia comprised of three circles represents a higher level of difficulty for identifying the illustrated object than indicia comprised of two circles or one circle. The level of difficulty of identifying the object 14 illustrated in FIG. 2*a* is indicated by a single circle 20 which represents the lowest level of difficulty. The identification of the depicted object which appears below the object is obscured by any suitable means such as ink from a marking pen so that only a solid line 48 appears. Other descriptive information concerning the object such as words 16 are not obscured. The front side 8 of the card includes a second set of indicia 18 which represents the number of letters in the word or words which identify the object.

As shown in FIG. 2*b*, back side 28 of card 6 contains word 22 "caribou" which identifies object 14 on front side 8 of card 6. Back side 28 also includes a definition 26 and pronunciation 24 for word 22. Single circle 20 indicative of the level of difficulty of the identification appears on back side 28 as well as front side 8.

Figure 3A:
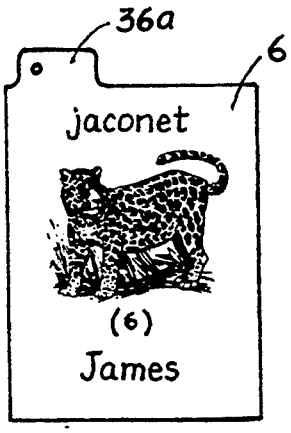
FIGS. 3*a*, 3*b* and 3*c* are planar front views of three different cards having offset tabs positioned in various locations.
Figure 3B:
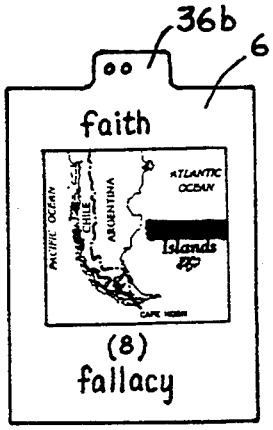
Figure 3C:
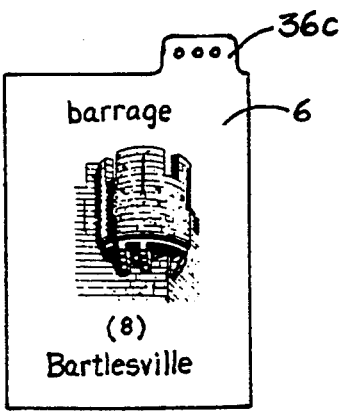
Figure 4:
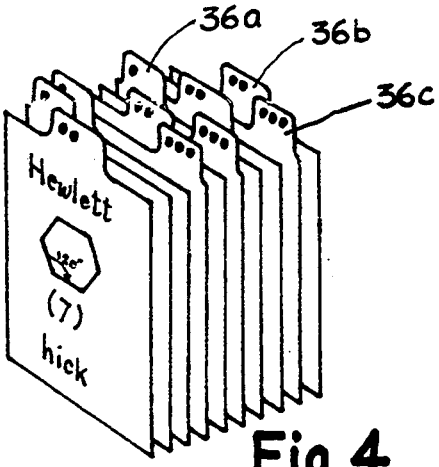
FIG. 4 is a perspective view of a deck of cards for the game of this invention wherein each card has an offset tab.

Each card in the deck has a different object depicted on its front side and, therefore, no two cards are the same. Some objects are more difficult to identify than others and, as previously explained, the level of difficulty is indicated by a set of indicia which appears on the front side and back side of each card. While the indicia shown in the drawings are formatted as circles, they can be of any other configuration such as stars, dots, broken lines, letters or numbers. When the game is played, in some instances it is advantageous to separate the deck in a manner such that cards having the same level of difficulty are stored together in one part of the container as shown in FIGS. 1*b* and 1*c*. This aids in the identification and selection of cards having a specified level of difficulty. The indicia may also be set forth on tab 36*a*, 36*b* or 36*c* which is positioned at the top of the card as shown in FIGS. 3*a*, 3*b* and 3*c*. Tabs 36*a, b* and *c* are offset from one another so that tabs in a like position identify cards having the same level of difficulty. The use of tabs eliminates the need to store separately cards having the same level of difficulty. FIG. 4 illustrates a deck of randomly arranged cards having various levels of difficulty. Because of the offset arrangement of tabs 36*a*, 36*b* and 36*c*, the level of difficulty of each card is easily ascertainable when the game is played. As seen in FIGS. 3*a*–3*c* and FIG. 4, the amount of offset of each tab 36 from a common reference point, e.g., the left edge, increases with the level of difficulty represented by the indicia 20 thereon.

There is no limit on the number of cards contained in the deck. As few as several dozen cards may be used to as many as 3,000 or more. For wide selection of cards while retaining ease of storage and portability, a deck comprising from 1,000 to 2,000 cards is very satisfactory. Nor is there a limit on the number of levels of difficulty for classifying the cards. However, 3 to 6 levels are suitable for meeting a wide range of individual abilities and skill levels. While the game can be played without classifying the cards by level of difficulty, the competitive interest in the game is increased when at least 2 but not more than 10 levels of difficulty are employed.

The picture on the front of the card may be produced by any means which adequately illustrates the word or words the back of the card for purposes of the game. A definition or brief description of the depicted object may accompany the identifying word or words. In a preferred embodiment, the information on each side of the card is a replica of information from a selected published dictionary such as *The Random House Dictionary of the English Language*, Jess Stein, Editor in Chief, published by Random House, Inc. In this embodiment, the illustration and its subtitles are reproduced exactly as shown in the selected published dictionary but with the identification word or words obscured as shown by 48 in FIG. 2*a*. The first and second words on the front of the card represent approximately the first and last words on the page on which the illustration appears in the published dictionary. In those instances where the actual first and last words from the page of the published dictionary define an alphabetical range so narrow as to make obvious the identification of the illustrated object, other words may be used which make the card more appropriate to the purpose of the game. The information on the back of the card, in accordance with the preferred embodiment, includes the identification, pronunciation and definition of the answer word or words as contained in the selected dictionary associated with the accompanying illustration.

There are several alternative methods for playing the game using the deck of cards described herein. However, certain basic procedures which are central to the game are common to all variations. While any number of contestants may participate, the game is most suitable for 2 to 4 players, where "player" is defined as either an individual or team of 2 or more persons. In one embodiment, a single individual may play the game as an educational version of solitaire. In addition to the deck of cards, the game includes a timing device and a score sheet or a game board with game pieces. The essential steps followed in playing all variations of the game include a player a) selecting a card from the deck, b) observing the information on the front side within a predetermined fixed time period, c) stating the word or words which identify the object depicted on the front side within the fixed time period, d) turning the card to its back side and observing the word or words which identify the object depicted on the front side and e) entering a score of a specified number of points appropriate to a correct or incorrect identification. All card selections are drawn from the front of the deck and returned to the rear of the deck. The score is posted either by entering it on a score sheet or by advancing a piece on a game board. It may also be posted on a tally sheet or board.

A timing device is started when the card is initially selected by the player. While any type of electrical or mechanical timer can be used, particularly suitable are timers that give a visual or audio signal upon the expiration of a predetermined fixed time period. The player reviews the information on the front of the card and attempts to identify the illustrated object before the expiration of the predetermined fixed time period as measured by the timer. A predetermined fixed time period within a range from a minimum of 10 seconds to a maximum of 60 seconds is usually sufficient and desirable to allow time for thought while keeping the game moving at a reasonable pace. If the object is correctly identified within the predetermined fixed time period, the player is awarded an appropriate score. In one variation, the awarded score is reflective of the level of difficulty as shown by indicia 20. Thus, a player is awarded a single score for a card containing a single circle, a double score for a card containing two circles and a triple score for a card containing three circles. When a game board is used, the score is manifested by advancing a game piece either one, two or three spaces on the game board.

The method for playing the game using the deck of cards described herein is subject to numerous variations. A player may select a card having a specified level of difficulty or the selection may be made on a random basis where the card's level of difficulty is unknown until drawn from the container. Ordinarily, after an answer is given by a player, whether it is correct or incorrect, play passes to the next player on a rotating basis. However, the game may be varied to permit a player to make another selection after each correct answer. The game is completed and a winner declared when a specified scoring level is achieved, when each player has drawn a predetermined and specified number of cards or when a player has advanced a game piece through all of the spaces on a game board. Where written score sheets are used, the scoring process can be formatted to simulate the play of a sporting activity such as baseball, golf, tennis, etc.

In another variation, each player in turn selects a card of the level of difficulty estimated to give the player the best chance of achieving a score which exceeds, or at least equals, the scores of all other players for that "round" of play (i.e. after one card has been drawn by each player). The game winner is either a) the player who wins the most rounds, or b) the player who first achieves a predetermined number of rounds won or c) the player with the highest total score including a premium awarded for each round. This variation introduces an element of strategy for each player in the selection of card level of difficulty in each round of play.

Set forth below is an exemplification of a typical procedure which is used when the game is played and scored by "rounds". Before play is begun, the contestants agree on the number of rounds, the time limit per turn and whether the winner is to be determined by rounds won, total score or both. A round consists of one turn (i.e. one card drawn) for each player, who may be a single contestant or a team of two or more contestants. The order of play is decided by drawing straws or an equivalent procedure. Each card is classified into one of three levels of difficulty. The lowest level of difficulty is indicated on the card by 1 circle. The highest level of difficulty is indicated by 3 circles and the intermediate level of difficulty by 2 circles.

When play is started, First Player selects a card from the deck which has a level of difficulty which the player expects will provide the best chance of attaining a score equal to or better than the opponent's score for that round. After the opponent has had a chance to glance at the card, First Player starts to study the front of the card as the timer is started. If First Player correctly identifies the word or phrase represented by the picture (and consistent with the number of letters specified) within the predetermined time limit, he scores 1, 2 or 3 points for Round 1, depending on the level of difficulty of the card. If First Player does not give the correct identification for a card with the intermediate (i.e. 2 circles) or highest (i.e. 3 circles) level of difficulty, he scores 0 points. If he does not give the correct identification for a card with the lowest level of difficulty (i.e. 1 circle), he scores an "X" which means 0 points and loss of round. Correct identification is defined by the word or phrase as printed on the back of the card.

Second Player now knows what score he must achieve to tie or beat the Round 1 score of First Player and accordingly chooses a card having an appropriate level of difficulty. The remainder of his turn is the same as for First Player. If there are more than two players, subsequent turns in Round 1 are similar to that for Second Player, each successive player having more information to influence his choice in selecting a card with the appropriate level of difficulty. The player with the highest number of points in the round wins that round. The sequence of play in subsequent rounds is the same as for Round 1, but first turn rotates among players (e.g. 1,2; 2,1; 1,2; . . . or 1,2,3,4; 2,3,4,1; 3,4,1,2; 4,1,2,3; 1,2,3,4; . . . etc.).

The foregoing demonstrates the stragetic and competitive aspects which are involved in playing one variation of the game. These same aspects are present in other variations as well.

The invention has been described with specific reference to a preferred embodiment hereof. However, other variations and modifications can be effected within the spirit and scope of the invention. For example, the selected card can be displayed by positioning it on an easel of a reflective overhead projector so that each card can be viewed simultaneously by all players. Simultaneous viewing can also be achieved by displaying the card on a computer screen or on a television screen. Also, rather than storing the deck of cards in a container, it can be electronically stored on a computer disc or on a photo compact disc.

I claim:

1. An educational card game comprising:

a. a number of decks of cards wherein each card has:

i. a front side bearing a first word, a second word, a replica of an illustration of an object as depicted on the page of a dictionary said object being identifiable by a word or words the spelling of which is alphabetically sequenced between the spelling of the first word and the spelling of the second word;

ii. a tab positioned on the edge thereof having a first set of indicia thereon which represents the level of difficulty of identifying the object, wherein tabs representing the same level of difficulty have the same relative positions on the edges of the various cards and are offset from tabs that are positioned on the edges of cards having different levels of difficulty, the amount of offset of each tab from a common reference point increasing with the level of difficulty represented by the indicia thereon; and iii. a back side bearing a word or words which identify the object depicted on the front side; and b. a container for the decks of cards, said container having a number of compartments which corresponds to the number of levels of difficulty comprising the first set of indicia, each compartment being configured so that only the portion of the foremost card of each deck bearing the first set of indicia is visible to a player and wherein each compartment contains a deck of cards having the same level of difficulty.

2. The card game described in claim 1 wherein the backside of each card includes a definition and pronunciation of the word or words which identify the object depicted on the front side.

3. The card game described in claim 1 wherein the front side of each card includes an upper section bearing the first word, a lower section bearing the second word and a middle section bearing the illustration which depicts an object identifiable by a word or words the spelling of which is alphabetically sequenced between the spelling of the first word and the spelling of the second word.

4. The card game described in claim 1 wherein the front side of each card includes a second set of indicia representing the number of letters in the word or words which identify the object depicted on the front side.

5. The card game described in claim 1 wherein the information on the front side of the card is a replica of the following information from a page of a published dictionary:

a. an illustration and its subtitles, exactly as shown on the page of the dictionary but with identification word or words obscured;

b. the approximate first and last words on the page of the dictionary on which the illustration appears, which correspond to the first and second words on the front side of the card; and wherein the information on the back side of the card is the identification, pronunciation and definition of the word or words in the dictionary depicted by the illustration.

* * * * *